United States Patent [19]

Godfrey

[11] 4,190,233

[45] Feb. 26, 1980

[54] JACK

[76] Inventor: Charles J. B. Godfrey, 334 Reid St., Forest City, N.C. 28043

[21] Appl. No.: 921,054

[22] Filed: Jun. 30, 1978

[51] Int. Cl.[2] ..... B66F 3/46

[52] U.S. Cl. ..... 254/4 B; 254/8 B; 254/124

[58] Field of Search ..... 254/139, 139.1, 143, 254/8 R, 8 B, 4 R, 4 B, 2 R, 2 B, 122, 124; 269/17

[56] References Cited

U.S. PATENT DOCUMENTS

| | | | |
|---|---|---|---|
| 3,059,785 | 10/1962 | Buckeye | 254/124 |
| 3,671,015 | 6/1972 | Sullivan | 254/143 |

*Primary Examiner*—Robert C. Watson

*Attorney, Agent, or Firm*—Blair, Brown & Kreten

[57] ABSTRACT

A jack is provided that is adapted to be used for lifting and handling heavy objects or loads such as vehicle engines, heads, manifolds, air conditioners and the like. The jack includes a means for permitting the device to be motor operated or manually operated. The jack is mounted on swivel wheels and the jack can be maneuvered in various directions.

8 Claims, 6 Drawing Figures

FIG. 4
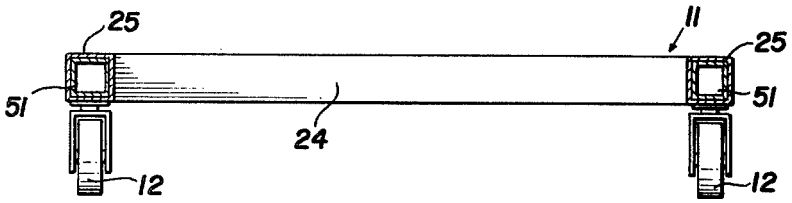
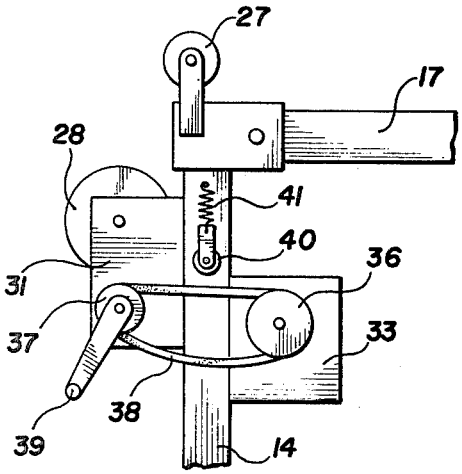
FIG. 5
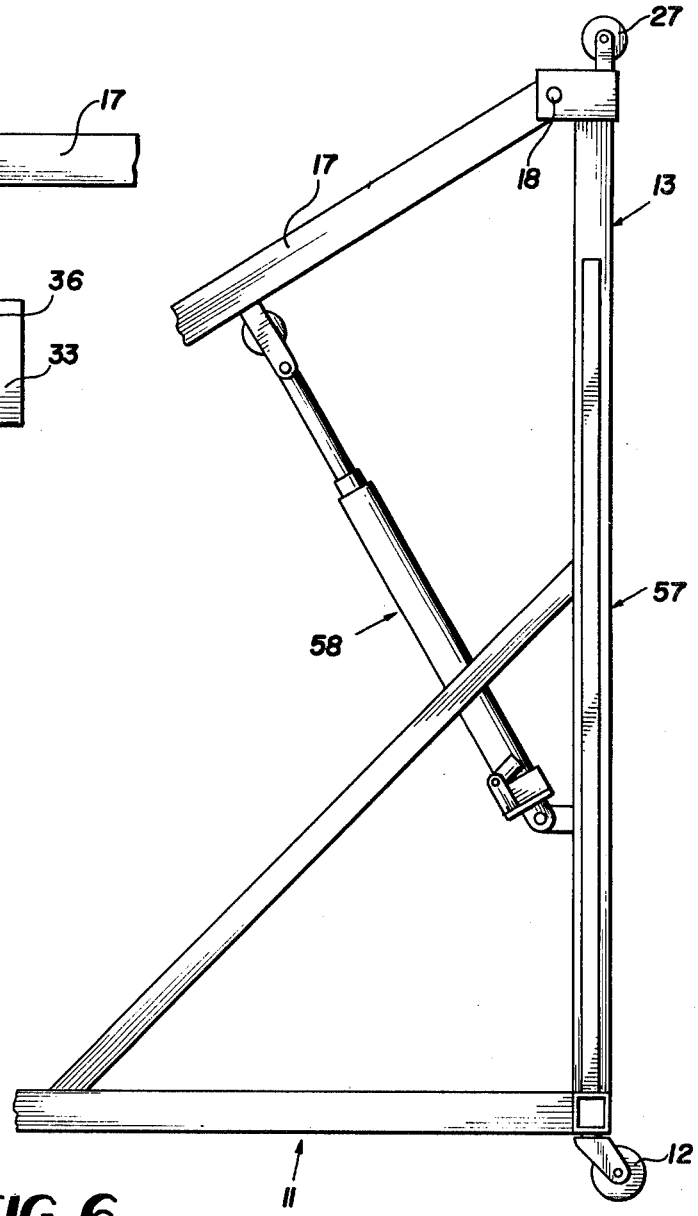
FIG. 6

JACK

BACKGROUND OF THE INVENTION

FIELD OF THE INVENTION

The present invention relates to a jack or hoist, and more particularly to a jack that can be conveniently maneuvered to facilitate the handling and lifting of various types of loads or objects such as those found in garages or other locations.

Jacks have been known to exist in the prior art for some time now, and patents of which this writer is aware include the following:

| | | | |
|---|---|---|---|
| 1,090,248 | Toepfer | 2,846,188 | Pierce |
| 2,585,982 | Wood | 3,337,187 | Sumner |
| 2,719,696 | Palka | | |

While each of the above patents disclose devices similar in nature they do not show the exact details of the structure delineated in the below explained specification, and more importantly, cannot provide a single operator with the mobility, flexibility and independability that the present structure, in toto, provides.

SUMMARY OF THE INVENTION

A handy jack is provided that includes a boom that can be conveniently adjusted or pivoted so that various types of loads such as the engines of automotive vehicles and the like can be raised or lowered as for example when such parts are being worked on, and wherein there is provided a scissor jack unit that can be used for supporting the load when the same is being maneuvered or handled. An electrically operated motor is provided for actuating the boom, and in some instances the mechanism can be manually actuated to accomplish the desired results. The entire unit includes a base that is mounted on swivel wheels so that the device can be moved from place to place as desired or required.

The primary object of the invention is to provide a jack that is especially convenient for use by automotive mechanics and the like as the jack will facilitate the removal of engines, heads, manifolds, heavy air conditioning units or other members of various automobiles, trucks and tractors.

Another object of the invention is to provide a handy jack that is constructed so that the parts can be extended or contracted as desired or required and wherein the jack is easily maneuvered in a desired direction, and wherein the jack of the present invention will permit the workman to work in a more safe manner when handling heavy loads.

Still another object of the invention is to provide a handy jack that is rugged in structure and simple and inexpensive to manufacture.

Other objects and advantages will become apparent in the following specification when considered in light of the attached drawings.

BRIEF DESCRIPTION OF THE DRAWINGS

FIG. 4 is a transverse sectional view illustrating certain constructional details of the present invention taken on lines 4—4 of FIG. 2;

FIG. 5 is a fragmentary elevational view illustrating a portion of the motor drive mechanism; and FIG. 6 is a fragmentary side elevational view illustrating a modification.

DESCRIPTION OF THE PREFERRED EMBODIMENT

Figure 1:
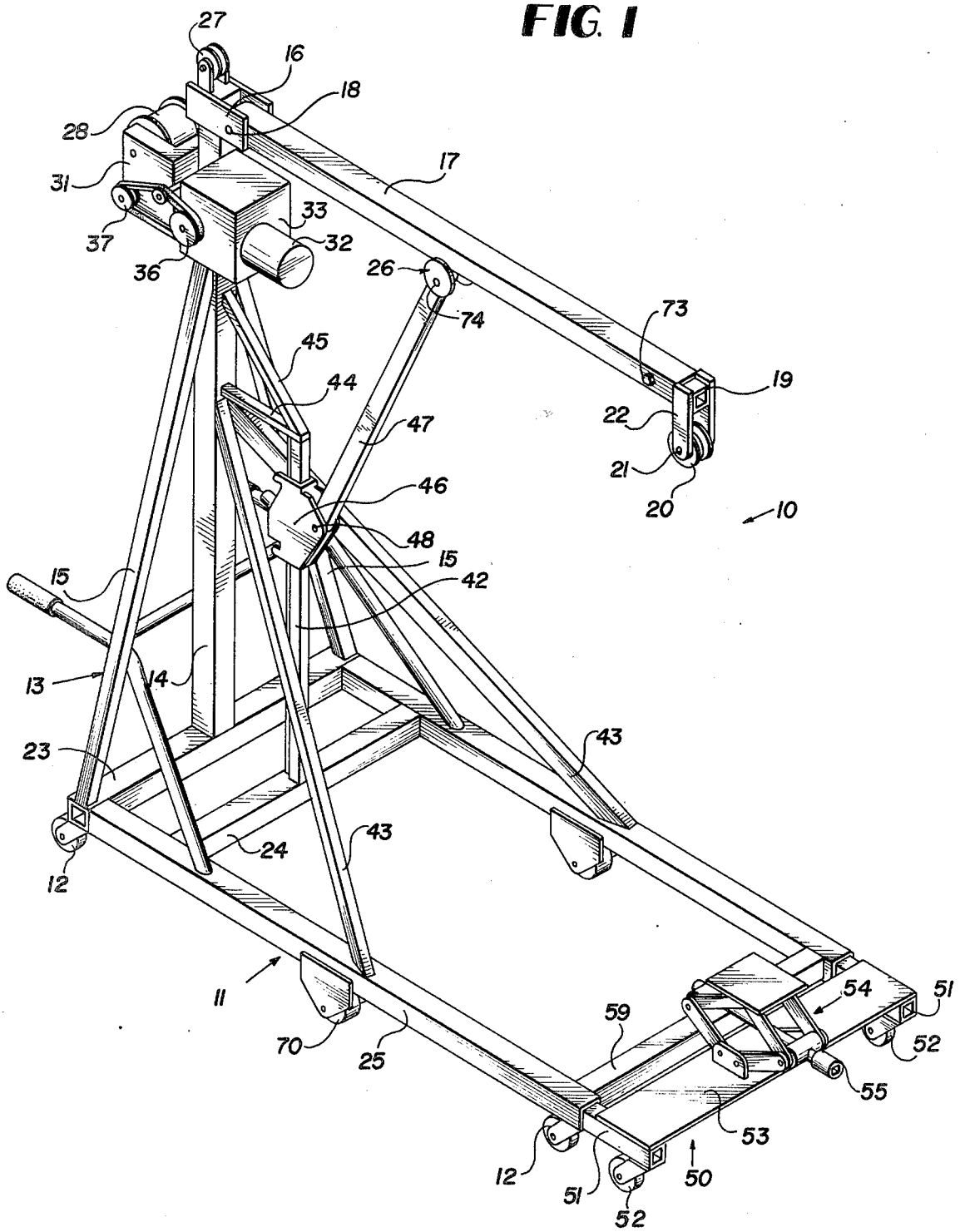
FIG. 1 is a perspective view of the jack of the present invention.

Referring now to the drawings in detail, the numeral 10 indicates the handy jack of the present invention that includes a base 11 that is horizontally disposed, and the base 11 is supported on swivel wheels 12, FIG. 1. The base 11 includes a pair of horizontally disposed spaced parallel hollow beams 25, and spaced apart cross pieces 23 and 24 extend between the beams 25 and are secured thereto.

A vertically disposed support unit 13 is mounted on one end of the base 11, and the support unit 13 includes a vertically disposed post 14 and incline braces 15.

Straps or bracket members 16 are suitably secured to the upper end of the post 14, and a boom 17 is pivotally connected to the straps 16 as at 18. A bar 19 is telescopically connected to the boom 17, and a pulley 20 is operatively connected to the outer end of the bar 19 as for example by means of straps 22, the pulley 20 being journaled in the straps 22 as at 21. A disc assembly or pulley assembly 26 is operatively connected to the lower portion of the boom 17, and a pulley 27 is mounted adjacent the post 14. There is provided a power operated winch 28 that has a cable 29 connected thereto, and the cable 29 is trained over the pulley 20, there being a hook member 30 on the free end of the cable 29 for engagement with a load such as a vehicle engine or other heavy member that is to be lifted or hoisted. A housing 31 is provided for supporting the winch 28, and a gear reduction unit 33 has a reversible motor 32 operatively connected thereto, FIG. 2.

A suitable remote control switch 34 can be electrically connected as at 35 to the motor 32 in order to control actuation of the winch 28 and cable 29.

As shown in FIG. 5, a pulley arrangement including a endless belt 38 is provided, and the belt 38 engages pulleys 36 and 37. A hand crank 39 can be selectively used for actuating these parts when desired or required. An idler 40 is mounted for movement into and out of engagement with the belt 38, there being a spring member 41 operatively connected to the idler 40, for a purpose later to be described.

An upright member 42 has its lower end secured to the cross piece 24, FIG. 1 and incline braces 43 stand between the members 25 and 14 and are suitably secured thereto as by welding. A jack member 46 is adjustably mounted on the upright member 42, and a rod 47 has its lower end pivotally connected to the jack member 46 as at 48, FIG. 2. The upper end of the rod 47 is pivotally connected to the boom 17 as at 49. Braces 44 and 45 are provided as shown in the drawings for helping to maintain the parts in their proper assemblied position.

Figure 2:
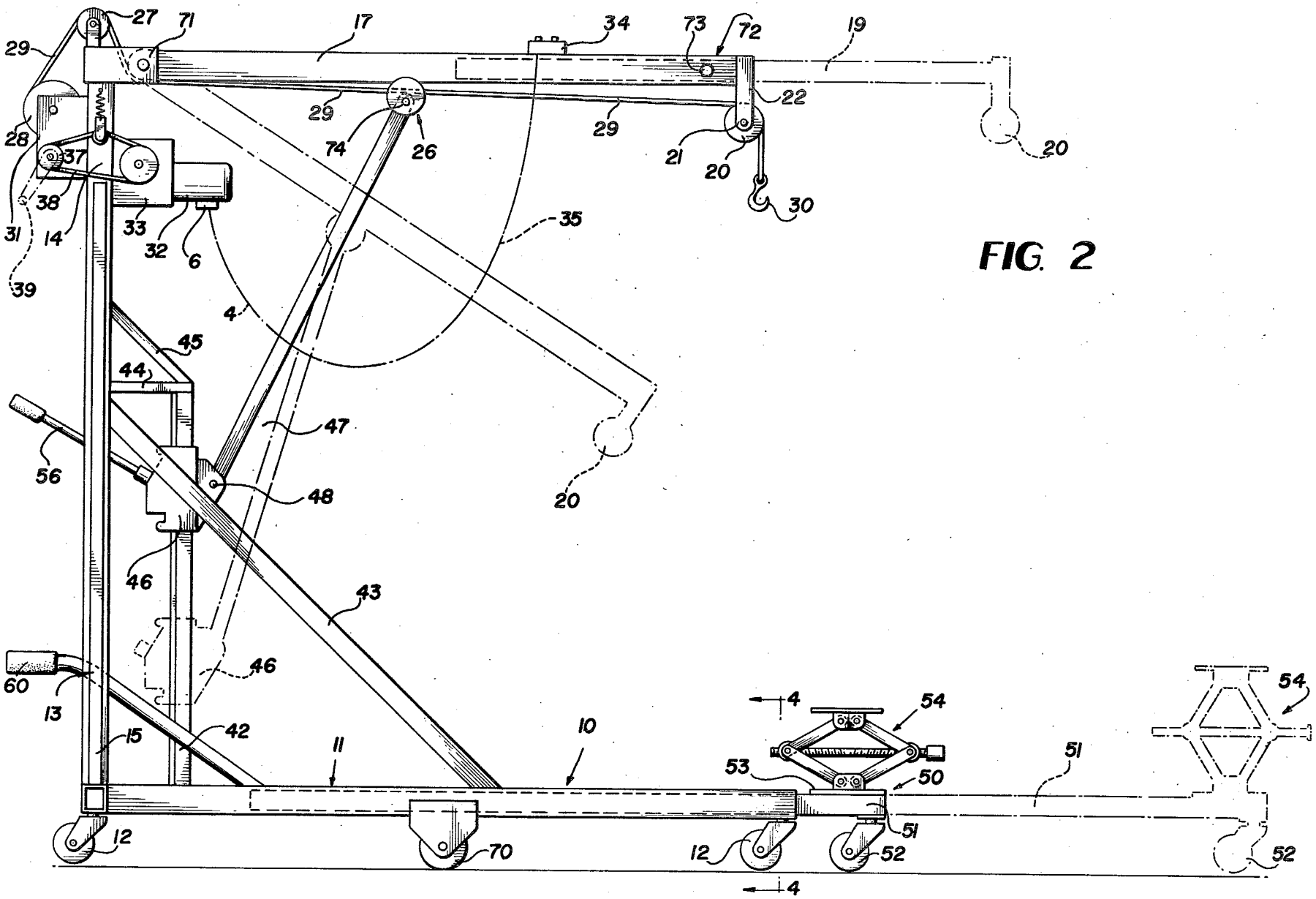
FIG. 2 is a side elevational view of the jack.
Figure 3:
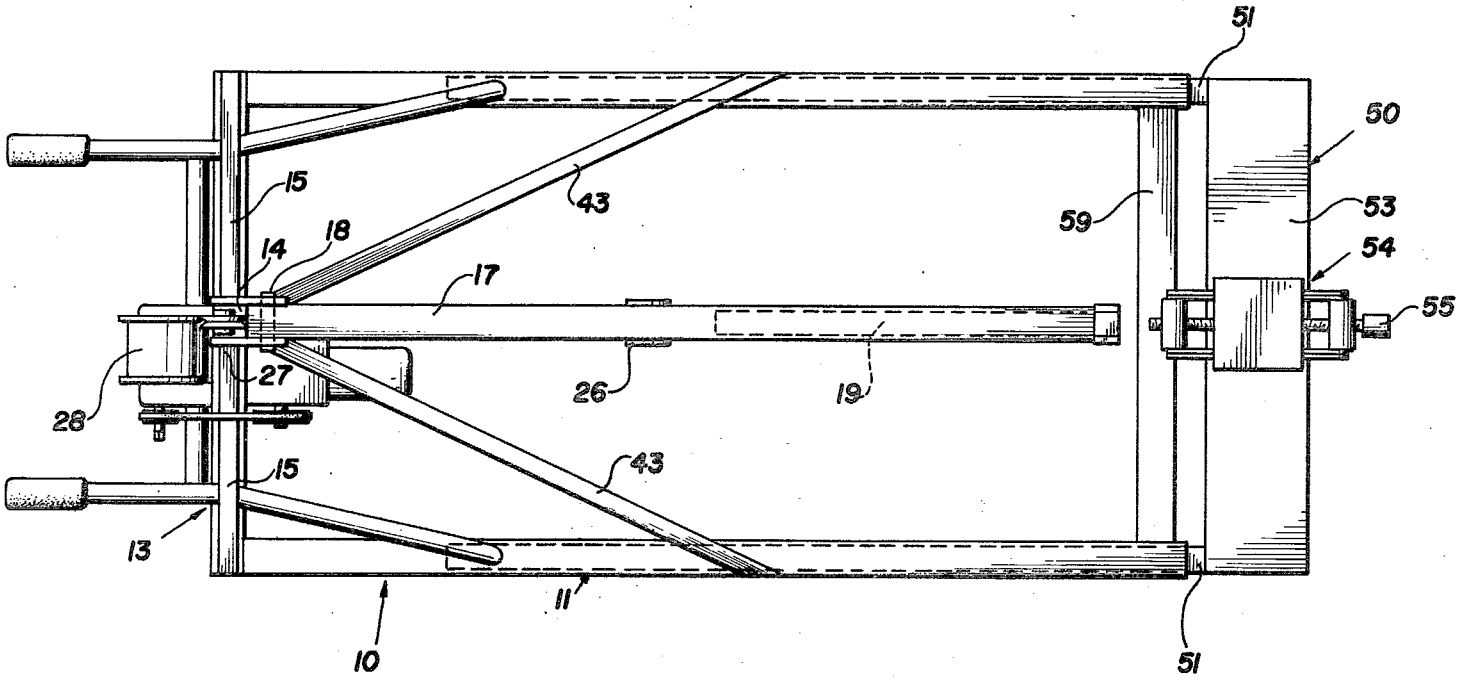
FIG. 3 is a top plan view thereof.

An extensible section 50 is adjustably connected to the base 11, and the section 50 includes channel members 51 that can slide in and out of the members 25. Swivel wheels 52 are provided for the section 50 and a horizontally disposed platform 53 extends between the members 51 and is suitably secured thereto. A jack such as a scissors jack 54 is mounted on the platform 53, and a suitable socket 55 is provided on the scissors jack 54 whereby a suitable tool can be used for actuating the jack. In FIG. 2 the numeral 56 indicates a manually operable handle that is used for actuating the jack member 46.

Referring to FIG. 6 of the drawings there is illustrated a slightly modified form of the handy jack that is indicated generally by the numeral 57, and wherein the jack 57 includes a base 11 as well as a unit or mechanism 58 that can be used for pivoting the boom 17.

A cross piece 59 extends between the beams 25 and is secured thereto by welding.

From the foregoing, it will be seen that there has been provided a handy jack, and in use with parts arranged as shown in the drawings, the hook 30 on the end of the cable 29 can be arranged in engagement with a load or member to be lifted as for example the hook 30 can be arranged in engagement with a vehicle engine or other heavy member. Then, by suitably actuating the remote control switch 34, the motor 32 can be actuated by means of the wires 35 so as to operate the winch 28 through the gear reduction unit 33. This actuation of the winch 28 will cause the cable 29 to be moved in the desired manner so that for example the load engaged by the hook 30 can be lifted in the convenient safe manner. If desired, the load can be placed on the scissors jack 54 so as to facilitate working on the engine or other member being handled.

It is to be noted that the boom 17 is adjustable, that is by actuating the jack member 46 as for example by means of the handle 56, the boom 17 can be pivoted about axis extending through the pivot pin 18 so that for example the boom 17 can be moved from the solid line position shown in FIG. 2 to the broken line position shown in FIG. 2 whereby the parts can be adjusted to their desired position.

Similarly, the effective length of the boom 17 can be varied as desired due to the provision of the bar 19 which telescopes in the boom 17. Also, the section 50 is adjustably connected to the base 11 so that for example the section 50 with the scissors jack 54 thereon can be moved to a position such as that shown in solid lines in FIG. 2 to a position such as that shown in broken lines in FIG. 2 whereby the parts can be adjusted to a desired position. In FIG. 6 a different type of mechanism 58 can be provided for pivoting the boom 17.

The parts can be made of any suitable material and in different shapes or sizes as desired or required.

The jack of the present invention can be used various purposes as for example for lifting transmissions from automobiles as for example when a transmission is to be removed from an automobile and placed on a workbench for repair. The handy jack of the present invention is especially advantagious to people working in garages, service stations and the like. The jack can be used for removing heads, manifolds, heavy air conditioner units and the like from automobiles, trucks, trailors and other like equipment. The jack includes a transmission base built into the base of the jack which will extend from approximately 5 feet to 8 feet or more in length so that transmissions and the like can be removed from various types of automobiles and trucks. The jack is mounted on swivel wheels so that the jack can be maneuvered in any direction and the jack can be completely turned around in a circle. By using the jack, there will be less likelihood of back injuries, less likelihood of accidents occuring, so that the people using the jack can work with increased safety.

Suitable handle bars 60 can be connected to the jack whereby the jack can be rolled in any desired direction. The swivel wheels 12 provide mobility to the jack. The transmission jack 54 is mounted on the member 50 that is also provided with wheels 52. The idler tension wheel 40 selectively applies tension to the main belt 38 which pulls the main winch and this can be released by releasing tension on the spring 41 whereby the jack can be manually operated.

Two set wheels 70 are mounted midways on the jack to improve maneuverability. These two wheels 70 are approximately ¼" longer than the swivel wheels which raises the jack off the floor approximately ¼". This allows easier movement of the jack, and a complete circle can be made by the jack, in the event that the device is being used in a limited or confined space. The two wheels 70 are set and are the width of the jack base. By using these wheels 70, the physical effort needed to move the jack is minimized.

The pulley 71 is mounted sufficiently lower for better boom control. The cable 29 is close to the boom, and there will be less likelihood of person or object interferring with the cable.

On the end of the boom, there is provided an interlock device 72 which locks the telescopic extension of the boom. The load is permanently locked and is safe and secure. On the outer boom shell, a hole of approximately ⅜" in diameter is adapted to be bored so as to permit a ⅜" bolt 73 to be inserted or placed and this can be screwed in until it makes contact with the intertelescoping boom. A simple turn of a handle screwing the bolt to contact with the intershell secures the boom in place.

With further reference to the reduction gear, there is a further advantage in that this gear gives lift to the load without the need for braking. This insures that no slippage or dropping the load occurs. The load may be stopped at any point from the top of the boom to the floor with no braking.

With reference to the assembly 26, this is in the form of a pair of stainless steel disc which are welded to the boom on each side. The rod 47 is mounted between the disc 26 with a ¾" pin 74. The rod and pin are adapted to be made of a suitable material such as stainless steel to prevent rusting.

The cable 29 goes across the member 27 and the cable drops through to the rear of the boom and follows underneath the boom, through the middle of the stainless steel disc supports and onto the end of the boom pulley.

Having thus described the preferred embodiment of the invention it should be understood that numerous structural modifications and adaptations may be resorted to without departing from the spirit of the invention.

What is claimed is:

1. A jack comprising a base frame defined by a first pair of horizontally disposed spaced parallel hollow beams interconnected at one end by a pair of cross pieces, and at another end by a further cross piece, a second pair of horizontally disposed spaced parallel beams telescopingly inserted within said first pair of beams at said further cross piece, said second pair of beams interconnected by a platform upon which first jack means are affixed, wheel underlying and supporting said beams, a vertical frame carried by said base at the extremity thereof remote from said first jack means, said vertical frame comprising a vertical post joined to a central portion of one cross piece having plural angled braces extending from said first pair of spaced hollow beams to said vertical post, an overhead boom hinged at one extremity thereof to a top portion of said vertical post, said boom extending over said first pair of hollow beams, and means for pivoting said boom about said vertical post.

2. The device of claim 1 in which said boom further defines a hollow sleeve within which a bar slides, a locking pin extending through said sleeve and bar to lock same together, a first pulley connected to the outer end of said bar, a second pulley depending from said boom, a third pulley mounted adjacent the upper end of said vertical post, a winch arranged contiguous to the upper end of said vertical post, a cable connected to said winch and arranged in engagement with said pulleys and a hook on said cable for engaging a load to be hoisted.

3. The device of claim 2 wherein said means for pivoting said boom comprises a hydraulic cylinder extending between said vertical post and said boom.

4. The device of claim 2 in which said means for pivoting said boom comprises an upright member parallel to said vertical post extending from a second cross piece on said base to horizontal and diagonal braces that extend therefrom to said vertical post, a second jack on said upright member capable of riding thereon and a rod extending from said second jack to said boom whereby moving said second jack pivots said boom.

5. The device of claim 4 wherein said first jack defines a scissors jack.

6. The device of claim 5 in which handles are provided to roll said jack.

7. The structure as defined in claim 2 further including a gear reducing unit operatively connected to said winch, an electric motor operatively connected to said gear reducing unit, belt means for said motor and gear reducing unit, and remote control switch means for controlling actuation of said motor.

8. The device of claim 7 further including a spring biased idler carried on said vertical post, engaging said belt for tensioning said belt.

* * * * *